US006401955B1

(12) United States Patent
Yang

(10) Patent No.: US 6,401,955 B1
(45) Date of Patent: Jun. 11, 2002

(54) CONTAINER ASSEMBLY AND CONTAINER UNIT

(76) Inventor: Chun-Tse Yang, 10, Alley 1, Lane 3, Wen-Chien Road, Niao-Sung Hsiang, Kaohsiung (TW)

( * ) Notice: Subject to any disclaimer, the term of this patent is extended or adjusted under 35 U.S.C. 154(b) by 0 days.

(21) Appl. No.: 09/599,990

(22) Filed: Jun. 23, 2000

(30) Foreign Application Priority Data

Jun. 23, 1999 (TW) ..... 88210372 U

(51) Int. Cl.[7] ..... B65D 11/00

(52) U.S. Cl. ..... 220/23.87; 220/574; 220/671; 220/672

(58) Field of Search ..... 220/23.87, 574, 220/574.3, 4.21, 4.26, 592.2, 592.27, 921, 671, 673, 672

(56) References Cited

U.S. PATENT DOCUMENTS 2,895,636 A * 7/1959 Martin ..... 220/574
3,443,715 A * 5/1969 Edwards ..... 220/671
3,539,075 A * 11/1970 Bautista ..... 220/23.87 X
3,550,803 A * 12/1970 Pelli ..... 220/23.87 X
5,067,622 A * 11/1991 Garver et al. ..... 220/672 X

* cited by examiner

*Primary Examiner*—Steven Pollard
(74) *Attorney, Agent, or Firm*—Blakely Sokoloff Taylor & Zafman

(57) ABSTRACT

The present invention relates to a container assembly comprising a first container unit and a second container unit. The first container unit is used to receive articles. The two container units are connected by fastener members. The first container unit is spaced apart from the second container unit to define a distance for isolation. The second container unit has a transversely corrugated section formed on a lower portion of the container unit to allow the user to easily hold the container assembly, to strengthen the support of the container assembly and to increase the capacity of the container assembly. In consideration of convenience and environmental protection, after the container assembly is used, the two container units can be separated. The first container unit can be thrown away, and the second container unit can be used again to connect to a new first container unit. The container assembly is therefore economic and convenient.

4 Claims, 5 Drawing Sheets

CONTAINER ASSEMBLY AND CONTAINER UNIT

BACKGROUND OF THE INVENTION

1. Field of the invention

The present invention relates to a container assembly, more particularly, to a container assembly comprising two container units.

2. Description of the Related Art

Referring to FIG. 1, a container is made of plastic, and is commonly used to receive noodles. However, plastic containers may generate poisons harmful to people when the plastic container is exposed to high temperatures. Besides, the plastic container is non-recyclable, highly flammable and toxic after using, and thus causes significant problems to the environment. Based on the considerations of environmental protection and health, now there is a container made of pulp. Pulp containers cannot receive much liquid because their support is limited. Therefore, only paper cups are often used. As the thickness of paper cups are very thin, it is difficult for users to hold the paper cup when it is full of liquid having a high temperature. Though the support of the pulp container can be strengthened by increasing the thickness of the pulp container, the capacity of the pulp container is still limited. The pulp container cannot be used to receive a high capacity of liquid. Therefore, based on environmental protection and actual application, it is necessary to provide a creative and progressive container structure to overcome the above problems.

SUMMARY OF THE INVENTION

One objective of the present invention is to provide a container assembly comprising two container units. The two units are connected so that when they receive the article, they have the effect of separating the contents.

Another objective of the present invention is to provide a container assembly comprising two container units. The support of the container assembly can be strengthened by connecting the two container units so that the capacity of the container assembly can be increased.

Still another object of the present invention is to provide two container units so that they may be connected to form a container assembly. The two container units can be separated from each other so that one of the two container units can be re-used.

DETAILED DESCRIPTION OF THE INVENTION

Figure 1:
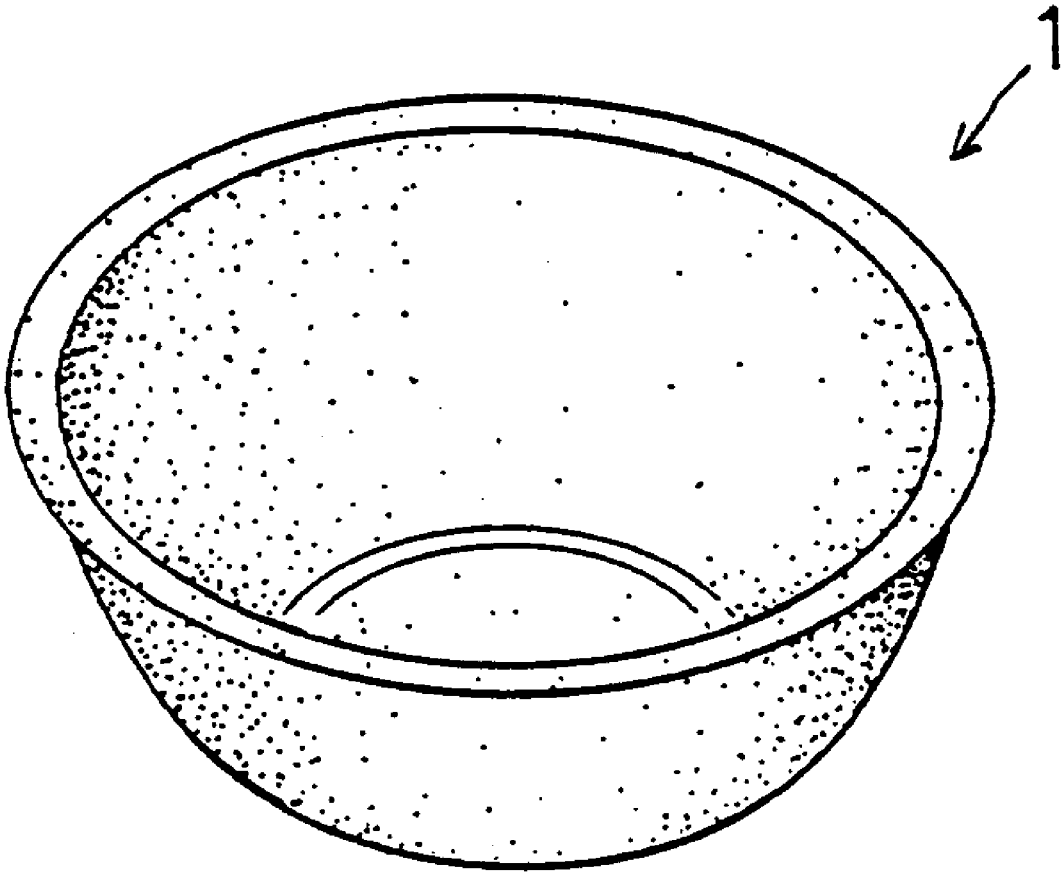
FIG. 1 shows a perspective view of the conventional plastic container.
Figure 2:
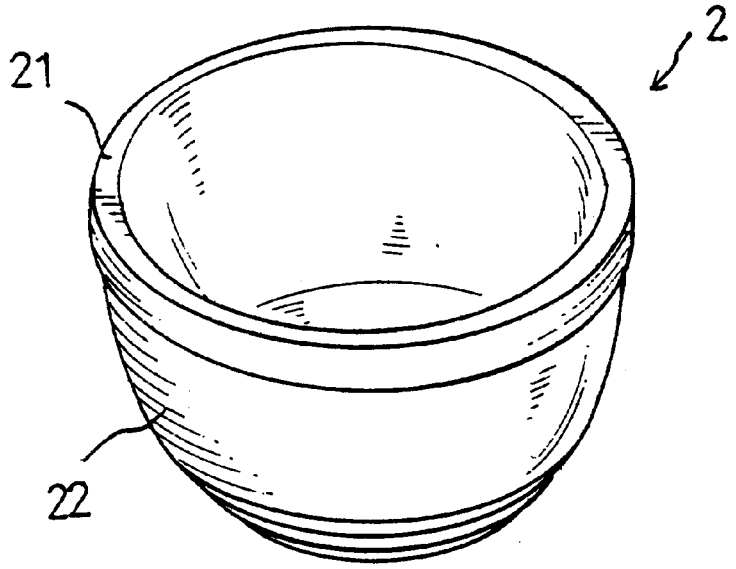
FIG. 2 shows a perspective view, according to the preferred embodiment of the invention.
Figure 4:
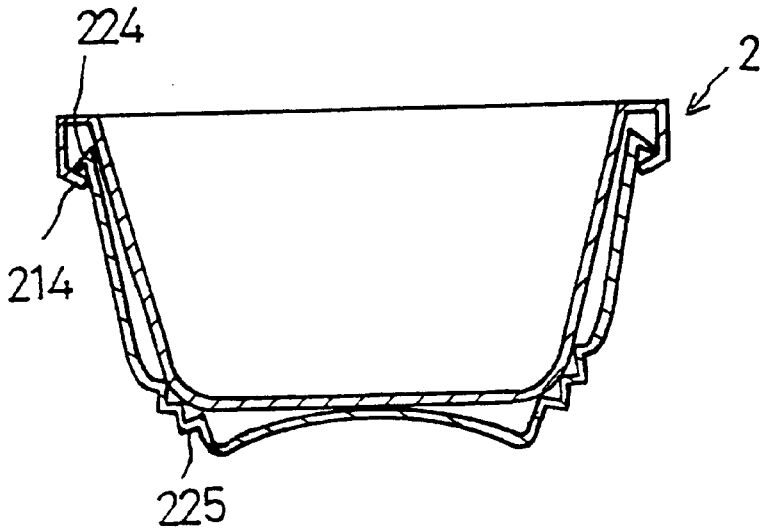
FIG. 4 shows an exploded perspective view, according to the preferred embodiment of the invention.
Figure 3:
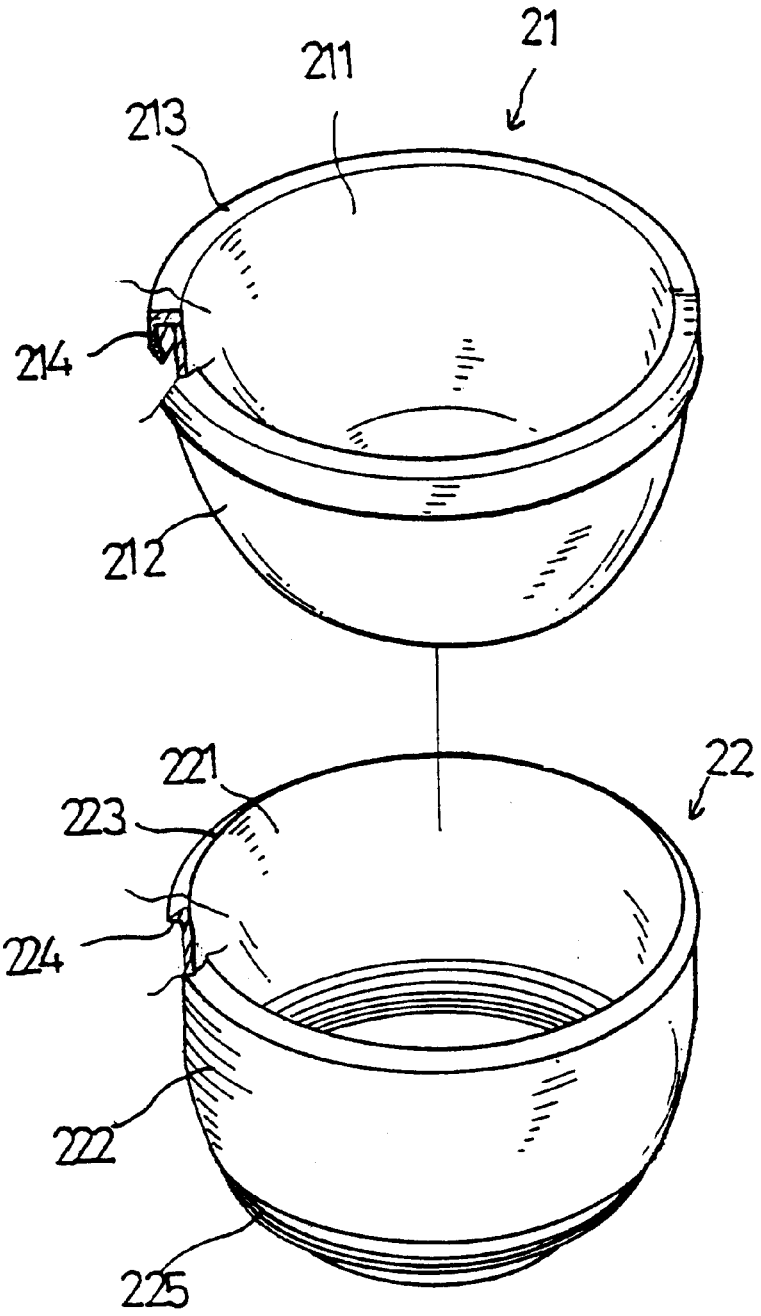
FIG. 3 shows a cross-sectional view, according to the preferred embodiment of the invention.

Referring to FIGS. 2, 3 and 4, a container assembly 2 comprises: a first container unit 21 and a second container unit 22. The first container unit 21 has an inside 211, an outside 212 and a first upper edge 213. The first upper edge 213 defines an opening for receiving articles into the first container unit 21. The first upper edge 213 has a first fastener member 214 disposed along the first upper edge 213. The first fastener member 214 is configured to a fold shape extending toward the outside 212 of the first container unit 21, as shown in FIG. 4.

The second container unit 22 is arranged along the outside 212 of the first container unit 21. The second container unit 22 has an inside 221, an outside 222 and a second upper edge 223. The second upper edge 223 defines an opening. The second upper edge 223 has a second fastener member 224 disposed along the second upper edge 223. The second fastener member 224 is configured to a hook shape extending outwardly, as shown in FIG. 4. The second fastener member 224 can connect to the first fastener member 214 of the first container unit 21. After connection, the first container unit 21 is spaced apart from the second container unit 22 to define a distance. Therefore, the container assembly 2 has an isolating effect. The user holds the second container unit 22 so that a high temperature liquid in the first container unit 21 cannot scald the user. When the first container unit 21 receives dangerous chemical solutions, the user can avoid directly touching the first container unit 21, which provides an isolating effect.

Figure 5A:
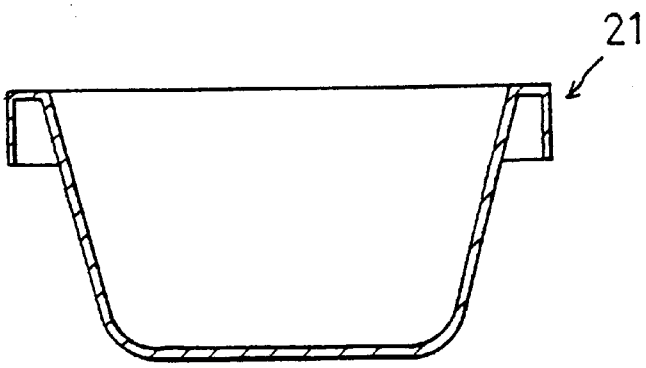
FIGS. 5*a* to 5*f* show the processes for manufacturing the two container units and the processes for connecting the container units.
Figure 5D:
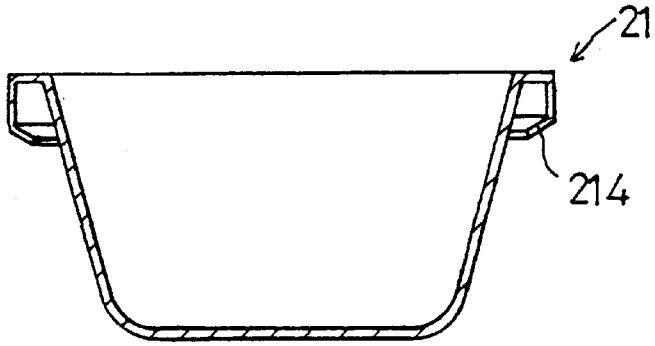
Figure 5E:
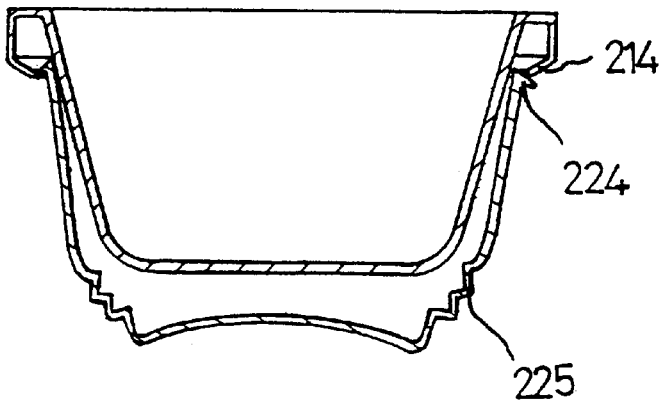
Figure 5F:
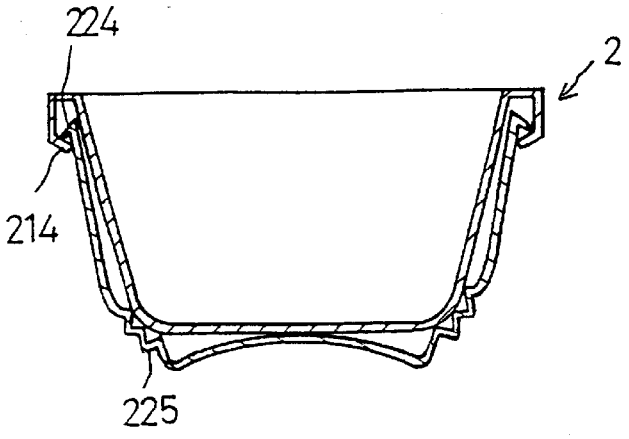
Figure 5B:
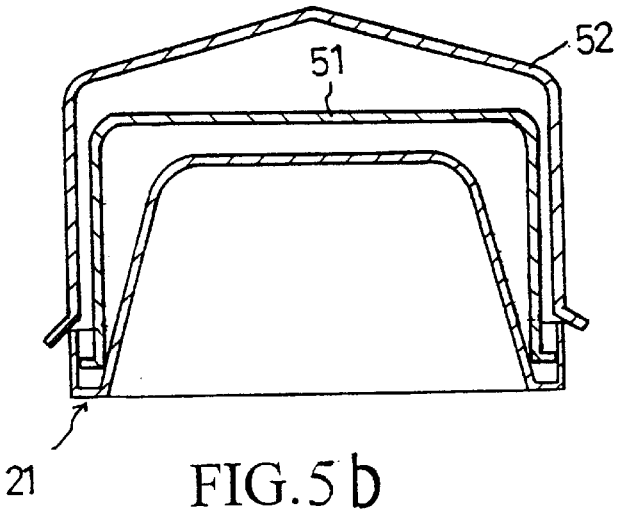
Figure 5C:
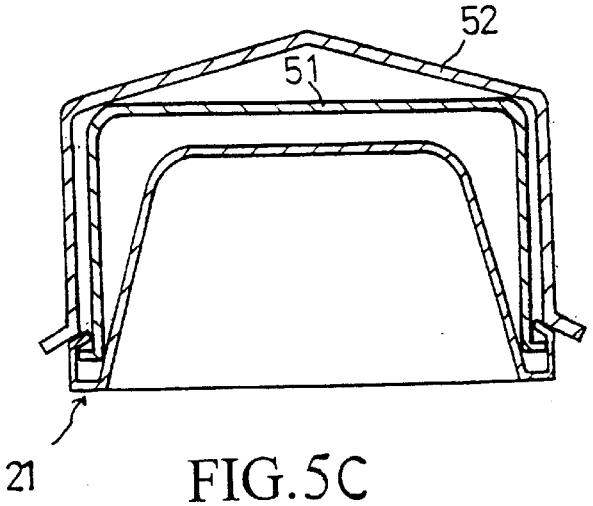

FIG. 5*a* to 5*f* shows the processes for manufacturing the two container units and the processes for connecting the container units. In manufacturing, the container units are made of pulp. The first container unit 21 is manufactured into a shape, as shown in FIG. 5*a*, in order to separate from the molding means which molds the first container unit 21. Two auxiliary tools 51 and 52 (referring to FIGS. 5*b* and 5*c*) are used to make the first container unit 21 form a fold shape toward the outside 212 of the first container unit 21. The second container unit 22 is arranged out of the outside 212 of the first container unit 21, and the second fastener member 224 forms a hook shape extending outwardly. Referring to FIG. 5*e*, in connection, the second container unit 22 is push from down to up. Referring to FIG. 5*f*, the fold shape of the first fastener member 214 restricts the second fastener member 224 from dropping. In using the container assembly 2, the first container unit 21 is used to receive the liquid, and the user holds the second container unit 22. Therefore, the connection state of the first container unit 21 and the second container unit 22 will be maintained, and the first container unit 21 does not separate from the second container unit 22, when the container assembly is used.

According to the invention, the material of the container assembly 2 may be sheet material such as plastic or pulp. If the first container unit 21 is made of pulp, the inside 211 of the first container unit 21 must have a water-proof coating on the surface of a portion of the inside 211 of the first container unit 21 to prevent the liquid from leaking. As the first container unit 21 is used to receive the liquid, the material of the first container unit 21 must match the properties of the liquid.

In consideration of convenience and environmental protection, the two container units 21 and 22 can be separated after the container assembly 2 is used. The first container unit 21, which directly contacts the liquid, can be thrown away, and the second container unit 22, which does not contact the liquid, can be used again to connect with a new first container unit. The container assembly 2 is cost effective and convenient.

The first container unit 21 and the second container unit 22 can be manufactured independently. It is predictable that the first container unit 21 will be used more than the second container unit 22 because the first container unit 21 can be thrown away and the second container unit 22 can be re-used.

To strengthen the support of the container assembly 2, the second container unit 22 has a transversely corrugated section 225 with projections and grooves. The corrugated section 225 is formed on a lower portion of the second container unit 22. After connection, the corrugated section 225 contacts a lower portion of the first container unit 21 to support the lower portion of the first container unit 21 and to strengthen the support of the first container unit 21. Therefore, the capacity of the container assembly 2 can be increased. Similarly, the second container unit may have a vertically corrugated section with projections and grooves to strengthen the support and raise the capacity of the container assembly 2. Consequently, the container assembly of the invention can be broadly utilized as a bowl and dish to receive liquids having high temperatures and high capacities, and can completely replace the conventional bowl or dish made of plastic. Besides, the corrugated section makes the container assembly easy to hold, and it is difficult for the container assembly to slip out of the user's hand when the user's hands are wet and slippery.

While a particular embodiment of the present invention has been illustrated and described, various modifications and improvements can be made by those skilled in the art. The embodiment of the present invention is therefore intended to be illustrative but not restrictive. It is understood that the present invention may not be limited to the particular forms as illustrated, and that all modifications which maintain the spirit and scope of the present invention are within the scope, as defined in the appended claims.

What is claimed is:

1. A container assembly, comprising:

a first container unit, having an inside, an outside and a first upper edge, the first upper edge defining an opening for receiving articles into the inside, the first upper edge having a first fastener member disposed along the first upper edge; and a second container unit, arranged along the outside of the first container unit, the second container unit having a second upper edge, the second upper edge having a second fastener member connecting to the first fastener member of the first container unit, the first container unit spaced apart from the second container unit to define a distance therebetween for isolation, the second container unit having a transversely corrugated section formed on a lower portion of the second container unit so as to define the distance with the first container unit and to support the container assembly.

2. The container assembly as claimed in claim 1, wherein the first fastener member is configured to a fold shape extending toward the outside of the first container unit, and the second fastener member is configured to a hook shape extending outwardly, the first fastener member being in engagement with the second fastener member so as to connect the first container unit with the second container unit.

3. A container assembly, comprising:

a first container unit, having an inside, an outside and a first upper edge, the first upper edge defining an opening for receiving articles into the inside, the first upper edge having a first fastener member disposed along the first upper edge; and a second container unit, arranged along the outside of the first container unit, the second container unit having a second upper edge, the second upper edge having a second fastener member connecting to the first fastener member of the first container unit, the first container unit spaced apart from the second container unit to define a distance therebetween for isolation, the second container unit having a vertically corrugated section formed on a lower portion of the second container unit to define the distance with the first container unit and to support the container assembly.

4. The container assembly as claimed in claim 3, wherein the first fastener member is configured to a fold shape extending toward the outside of the fist container unit, and the second fastener member is configured to a hook shape extending outwardly, the first fastener member being in engagement with the second fastener member so as to connect the first container unit with the second container unit.

* * * * *